US006020817A

United States Patent [19]

Copeland et al.

[11] Patent Number: 6,020,817

[45] Date of Patent: Feb. 1, 2000

[54] METHOD AND APPARATUS FOR ACTIVATING MAGNETOMECHANICAL EAS MARKERS WHILE PREVENTING FORMATION OF DEMAGNETIZATION FIELD

[75] Inventors: Richard L. Copeland; Ming R. Lian, both of Boca Raton, Fla.

[73] Assignee: Sensormatic Electronics Corporation, Boca Raton, Fla.

[21] Appl. No.: 08/745,829

[22] Filed: Nov. 12, 1996

Related U.S. Application Data

[63] Continuation-in-part of application No. 08/288,088, Aug. 10, 1994, abandoned.

[51] Int. Cl.[7] ..... G08B 13/187

[52] U.S. Cl. ..... 340/551; 335/302; 335/306; 340/572

[58] Field of Search ..... 340/551, 572; 335/302, 306

[56] References Cited

U.S. PATENT DOCUMENTS

| | | | |
|---|---|---|---|
| 4,510,489 | 4/1985 | Anderson, III et al. | 340/572 |
| 5,469,140 | 11/1995 | Liu et al. | 340/551 |
| 5,494,550 | 2/1996 | Benge | 340/572 |
| 5,495,230 | 2/1996 | Lian | 340/551 |
| 5,602,528 | 2/1997 | Witchger | 340/551 |

*Primary Examiner*—Glen Swann

*Attorney, Agent, or Firm*—Robin, Blecker, Daley and Driscoll

[57] ABSTRACT

A two-dimensional array of magnetomechanical markers is adhered to a continuous web. A magnetizer element is scanned across the web to magnetize the bias elements in a group of the markers with a first polarity, thereby activating the group of markers. The web is then advanced and the magnetizer is scanned across the web in an opposite direction to the previous scan, to magnetize the bias elements of a second group of the markers with a second polarity, thereby activating the second group of markers. The web is slit in a longitudinal direction to produce web-strips each carrying a column of the activated markers. The web-strips are rolled to form marker roll assemblies each having about half the bias elements magnetized with a first polarity and the remaining bias elements magnetized with an opposite polarity. The roll of activated markers forms no more than a minimal "leakage" magnetic field.

63 Claims, 9 Drawing Sheets

METHOD AND APPARATUS FOR ACTIVATING MAGNETOMECHANICAL EAS MARKERS WHILE PREVENTING FORMATION OF DEMAGNETIZATION FIELD

REFERENCE TO RELATED APPLICATION

This application is a continuation-in-part of U.S. patent application Ser. No. 08/288,088, filed on Aug. 10, 1994, now abandoned.

FIELD OF THE INVENTION

This invention relates to magnetomechanical markers used in electronic article surveillance (EAS) systems and, more particularly, to techniques for placing such markers in an activated condition.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone" the presence of the marker is detected and an alarm is generated. Some markers of this type are intended to be removed at the checkout counter upon payment for the merchandise. Other types of markers remain attached to the merchandise but are deactivated upon checkout by a deactivation device which changes a magnetic characteristic of the marker so that the marker will no longer be detectable at the interrogation zone.

A known type of EAS system employs magnetomechanical markers that include an "active" magnetostrictive element, and a biasing or "control" element which is a magnet that provides a bias field. An example of this type of marker is shown in FIG. 1 and generally indicated by reference numeral 20. The marker 20 includes an active element 22, a rigid housing 24, and a biasing element 26. The components making up the marker 20 are assembled so that the magnetostrictive strip 22 rests within a recess 28 of the housing 24, and the biasing element 26 is held in the housing 24 so as to form a cover for the recess 28.

As disclosed in U.S. Pat. No. 4,510,489, issued to Anderson et al., the active element 22 is formed such that the active element 12 has a natural resonant frequency at which the active element 22 mechanically resonates when exposed to an alternating electromagnetic field at the resonant frequency. Typically, when the marker 20 is assembled, the bias element 26 is in an unmagnetized condition, and the marker 20 is subsequently exposed to a magnetic field in such a manner that the biasing element 26 is magnetized to saturation, in order to provide the requisite bias field to cause the active element to have the desired resonant frequency. Magnetizing the bias element 26 places the marker 20 in an activated condition, so that marker 20 will interact with, and be detected upon exposure to, an interrogation signal generated at or near the resonant frequency of the active element.

The representation of the marker 20 in FIG. 1 is somewhat simplified, and should be understood as indicative of any one of a number of conventional forms in which magnetomechanical markers are actually manufactured. For example, the housing 24 typically includes a top wall (not shown) which intervenes between the active element 22 and the biasing element 26 to prevent the element 22 from being "clamped" by magnetic attraction to the element 26.

Deactivation of magnetomechanical markers is typically performed by degaussing the biasing element so that the resonant frequency of the active element is substantially shifted from the frequency of the interrogation signal. After the biasing element is degaussed, the active element does not respond to the interrogation signal so as to produce a signal having sufficient amplitude to be detected by detection circuitry.

It is customary to manufacture magnetomechanical markers in large batches, and then to activate the markers and ship them in large quantities (hundreds or thousands) to customers such as retailers or manufacturers, who in turn apply the markers to items to be protected from theft. According to a conventional technique for activating the markers, a two-dimensional array of markers is adhered to a release sheet and then the sheet is placed in a pulse coil magnetizer which applies a magnetic field to the markers so that all of the bias elements thereof are magnetized to saturation. Sheets with markers carried thereon are placed one by one in the pulse coil magnetizer to activate the markers and then are stacked in a box for storage and/or shipment to a customer. The conventional process is carried out so that in the resulting stacks of sheets, the respective longest dimensions of all of the markers are arranged parallel to each other, the bias elements 26 of the markers are magnetized along the length thereof, and the north pole of each of the magnetized bias elements 26 is oriented in the same direction in all of the markers. Typically, each sheet carries 50 to 100 markers or more, and about 50 to 100 sheets are contained in each box, so that some 2,000 to 5,000 markers or more are packed together in the box in close proximity to each other.

FIG. 2 schematically illustrates a top view of a box 30 containing sheets of markers which have been activated according to the conventional technique. The arrow 32 in FIG. 2 indicates the common direction of orientation of the north poles of the magnetized bias elements of the markers in the box 30. The aggregation of the magnetized bias elements 26 in the box 30, all having north poles oriented in the same direction, forms a substantial magnetic field proximate to the box 30, as indicated by flux lines 34 in FIG. 2. It will be seen that the flux lines 34 exit from the "north" end 36 of the box 30 and then loop back toward the "south" end 38 of the box 30. A representative marker 20, located at the top and toward the edge of the stack of markers within the box 30, is shown in FIG. 2.

A potential problem, not previously recognized in the prior art, has been noted by the inventors of the present invention. The magnetic field formed by the accumulated markers is experienced by the marker 20 as a "leakage" field oriented in a direction indicated by arrow 40, i.e., in a direction such that the leakage field tends to demagnetize the bias element of the marker 20 if the field is sufficiently strong. If the leakage field is strong enough to demagnetize the bias element 26 of the marker 20, then the marker 20 is placed, unintentionally, in a deactivated condition which causes the marker not to be detectable by the EAS detection equipment to be used with the marker.

According to another conventional practice, after the magnetizing field is applied to the sheets of markers, the sheets are cut into strips, and the strips are spliced end-to-end to form a long strip which carries a single column of markers, with the markers oriented transversely to the length of the strip. The long strips are then rolled to form a roll of markers on the release sheet. This practice again produces a large aggregation of markers, all of which have their bias elements magnetized with a north pole oriented in the same direction, thereby producing the same sort of leakage field illustrated in FIG. 2.

It has been customary to form the bias element 26 from a semi-hard magnetic material having a coercivity of 60 Oe or greater. Since the leakage fields generated by the accumulations of markers that have typically been produced do not exceed about 35 to 45 Oe, inadvertent deactivation of markers located at the edges of a stack or roll of markers has not proven to be a concern.

However, recently developed techniques, such as those disclosed in U.S. Pat. Nos. 5,495,230 and 5,469,140 (commonly assigned with this application) have made it practical to reduce the thickness of the marker housing 24. This, in turn, has led to denser packing of the markers in stacks of sheets or in rolls, and a potential increase in the strength of the leakage fields. Thus, there is an increased risk of inadvertent deactivation by "leakage" field demagnetization of the conventional bias element.

Furthermore, in patent application Ser. No. 08/697,629, filed Aug. 28, 1996 and having a common inventor and common assignee with this application, it has been proposed to form magnetomechanical markers with bias elements having substantially lower coercivities than conventional bias elements. For example, the '629 application discloses a bias element formed by heat-treating an alloy designated as Metglas 2605 SB1, which is commercially available from Allied Signal Inc. After the treatment disclosed in the '629 application, the material has a coercivity of about 19 Oe. Markers formed with bias elements of the treated SB1 material can be much more easily deactivated, when deactivation is desired, but also carry an increase risk of unintentional deactivation due to the leakage field produced by stacks or rolls of markers.

OBJECTS AND SUMMARY OF THE INVENTION

It is accordingly an object of the invention to provide practices which prevent unintended deactivation of magnetomechanical markers due to leakage fields formed by accumulated quantities of such markers.

According to an aspect of the invention, there is provided a roll assembly of magnetomechanical EAS markers, including a backing sheet having a length extent and a width extent, the length extent being at least ten times as long as the width extent, and a plurality of magnetomechanical markers adhered to the backing sheet, the markers each including an active element for resonating in response to an EAS interrogation signal and a bias element for applying a bias magnetic field to the active element, each marker having a longitudinal axis and being oriented relative to the backing sheet so that the longitudinal axis is transverse to the length extent of the backing sheet, the plurality of markers consisting of a first subset and a second subset, the markers of the first subset having respective bias elements that are magnetized with a north polarity oriented in a first direction that is transverse relative to the length extent of the backing sheet, the markers of the second subset having respective bias elements that are magnetized with a north polarity oriented in a second direction that is transverse relative to the length extent of the backing sheet and is opposite to the first direction, and each of the first and second subsets consisting of at least 30% and no more than 70% of the plurality of markers.

Further according to this aspect of the invention, each of the first and second subsets preferably consists of substantially 50% of the plurality of markers, and 5,000 markers or more are carried on the roll, but the roll does not produce a demagnetization field having a magnitude of more than 10 Oe. Moreover, it may be the case that each adjacent pair of the plurality of markers on the backing sheet includes a marker from the first subset and a marker from the second subset. For example, markers of the first and second subsets may alternate along the length of the backing sheet. The roll assembly is formed by rolling the backing sheet into a substantially cylindrical shape with the backing sheet forming a spiral cross-section of the roll assembly.

According to a further aspect of the invention, there is provided an accumulated quantity of magnetomechanical EAS markers, each marker including an active element for resonating in response to an EAS interrogation signal and a bias element for applying a bias magnetic field to the active element, the markers being adhered to a backing sheet and including a first subset of the markers and a second subset of the markers, the markers of the first subset having respective bias elements that are magnetized with a north polarity oriented in a first direction and the markers of the second subset having respective bias elements that are magnetized with a north polarity oriented in a second direction different from the first direction.

According to another aspect of the invention, there is provided a method of activating magnetomechanical EAS markers adhered to a continuous web, the method including the steps of first transporting a magnetizing element in a first direction transverse to the web and in proximity to a first group of the markers to magnetize respective bias elements of the first group of markers, then, after the first transporting step, indexing the web in a longitudinal direction of the web, and after the indexing step, second transporting the magnetizing element in a second direction transverse to the web and opposite to the first direction, and in proximity to a second group of the markers, different from the first group, to magnetize respective bias elements of the second group of markers. The method may further include, after the second transporting step, slitting the web in a direction parallel to the longitudinal direction of the web to form plural webstrips each carrying at least 50 of the markers, and rolling the web strips.

According to still another aspect of the invention, there is provided a magnetizer element for activating magnetomechanical EAS markers, the magnetizer element including a steel channel having a substantially U-shaped cross-section and a length extent transversely extending relative to the cross section, and a magnet housed in the channel and having a length extent parallel to the length extent of the channel, the magnet having a first magnetic polarity region on a first side of the magnet and extending parallel to the length extent and along an open side of the channel, and a second magnetic polarity region extending parallel to the length extent and on a second side of the magnet opposite to the first side, the second magnetic polarity region having a magnetic polarity opposite to that of the first region. The steel channel has first and second end portions at opposite ends of its length extent, and may have an end plate arranged at the first end portion of the channel and oriented orthogonally to the length extent of the channel. The magnetizer element may include a first plurality of discrete permanent magnets arranged adjacent one another in a first row, a second plurality of discrete permanent magnets arranged adjacent one another in a second row, both of the rows being mounted in the steel channel and extending in parallel to the length extent of the steel channel, and every magnet of the first and second pluralities having a first magnetic polarity region on a first side of the respective magnet, the first side being oriented toward an open side of the channel, and a second magnetic polarity region on a second side of the respective magnet opposite to the first side, the second magnetic polarity region having a magnetic polarity opposite to that of the first region, and all of the first regions having the same magnetic polarity. Alternatively, the magnetic polarity region on the first side of each magnet may be opposite to the magnetic polarity of the first magnetic polarity region of an adjourning magnet in the row, and each magnet in the second row may be located adjacent a corresponding magnet of the first row and have a first magnetic polarity region at its first side with a magnetic polarity the same as the first magnetic polarity region of the corresponding magnet of the first row. Moreover, all of the magnets of the first and second rows may have a length extent arranged parallel to the length extent of the steel channel and substantially equal to a width extent of the EAS markers to be activated by the magnetizer element.

In stacks or rolls of activated markers produced in accordance with the invention, roughly half of the bias elements of the markers are oriented in one direction and the other half are oriented in an opposite direction, so that large leakage magnetic fields are not produced by the stacks and rolls of markers and the risk of inadvertent deactivation of the markers is minimized or eliminated.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
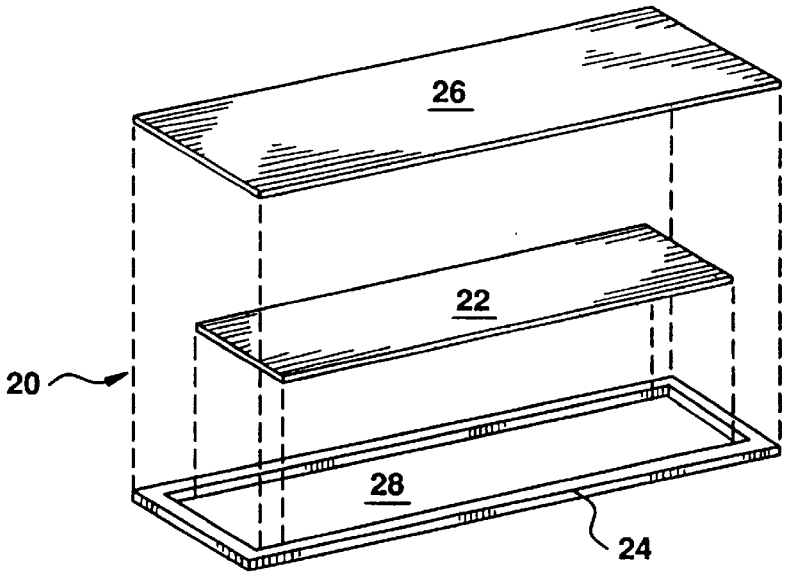
FIG. 1 is an isometric view showing components of a magnetomechanical marker provided in accordance with the prior art.
Figure 2:
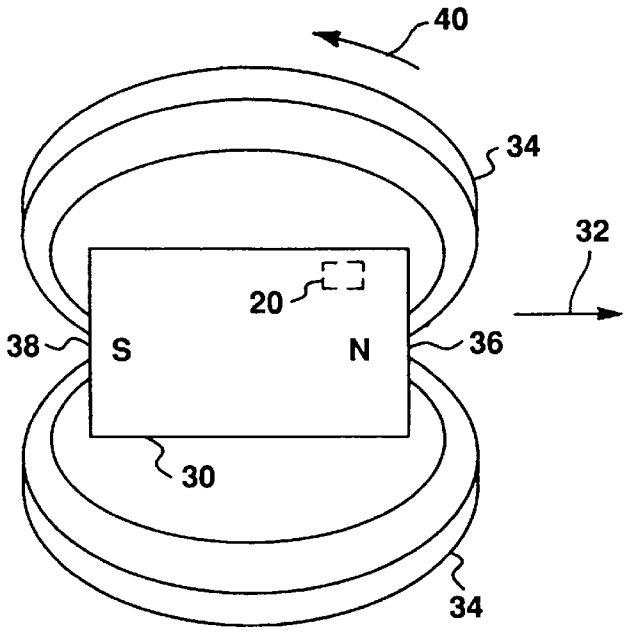
FIG. 2 is a schematic top view illustrating how an accumulation of activated magnetomechanical markers housed in a box generates a leakage magnetic field around the box.
Figure 3:
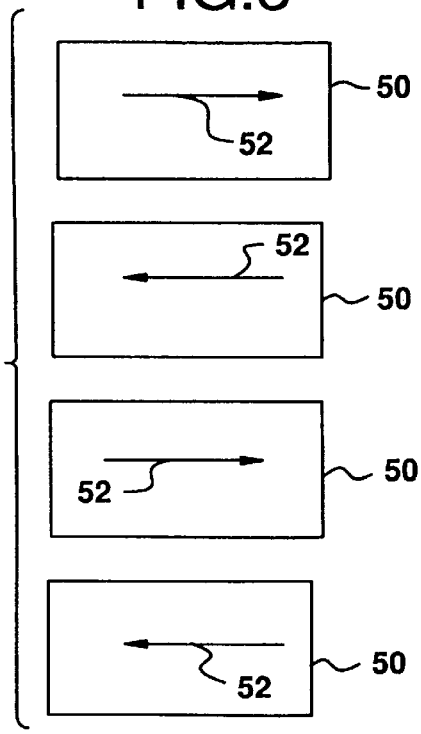
FIG. 3 schematically illustrates a novel practice for reorienting alternate ones of a sequence of backing sheets on which activated magnetomechanical markers are carried.

According to one departure from conventional practices, it is proposed that before sheets of activated markers are stacked, alternate ones of the sheets be reoriented so that the orientation of the north poles of the magnetized markers be shifted 180° from the orientation of the north poles of the markers on the other sheets. This practice is schematically illustrated in FIG. 3, which includes schematic representations of sheets 50 of activated markers (to simplify the drawing, the markers themselves are not shown on the sheets 50). An arrow 52, shown in each sheet, indicates the common direction of orientation of the north poles of the magnetized bias elements (not shown) of the markers on the respective sheet 50. It will be assumed that the rightward-pointing direction of the arrows 52 of the top and next-to-bottom sheets 50 are indicative of the direction of orientation of the north poles of the bias elements of those sheets as the sheets are taken out of a pulse coil magnetizer, whereas the leftward-pointing direction of the arrows 52 of the other sheets 50 indicate that those other sheets (next-to-top, and bottom) have been rotated by 180° so that the direction of orientation of the north poles of the bias elements on those sheets is opposite to the orientation when the sheets were removed from the pulse coil magnetizer. It is to be understood that alternate ones of other sheets to be stacked together would also be rotated in the same manner as the sheets having the leftward-pointing arrows 52. The resulting stack of sheets would then have approximately half of the bias elements of the markers with a north pole orientated in one direction and the other half of the bias elements with the north pole oriented in an opposite direction. Accordingly, the stack of activated markers would not generate a strong leakage field and would not present a serious risk that markers at the sides or edges of the stack might inadvertently be demagnetized by the leakage field.

Although it is preferred that there be substantially a 50:50 ratio of markers having bias elements magnetized in one direction vis-a-vis markers having bias elements magnetized in the opposite direction, it is believed that there can be some divergence from this ratio without causing a substantial leakage field to be formed. For example, it is believed that a ratio of up to 70:30 would not produce a leakage field that is large enough to cause a substantial risk of demagnetization, provided that the 70:30 ratio was maintained with reasonable uniformity throughout the stack of markers.

Figure 4:
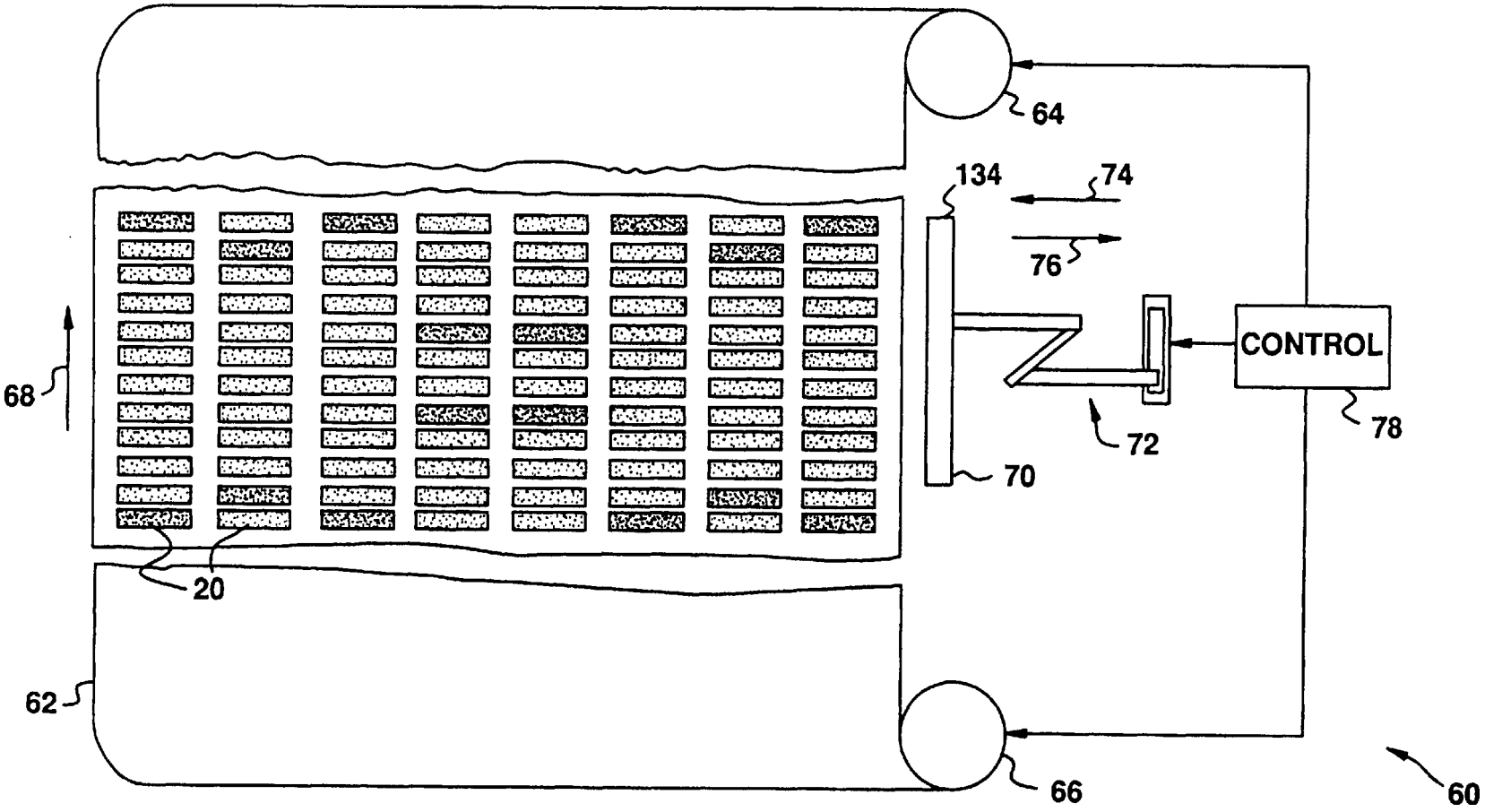
FIG. 4 is a partially block, and partially schematic, illustration of an apparatus for activating magnetomechanical markers in accordance with the invention.

There will now be described, initially with reference to FIG. 4, a practice provided in accordance with the invention which produces rolls of activated magnetomechanical markers that form no more than a minimal leakage field. Reference numeral 60 in FIG. 4 generally indicates a magnetizing apparatus provided in accordance with the invention. The magnetizing apparatus 60 processes a continuous web 62, to which a two-dimensional array of magnetomechanical markers 20 has been adhered. The web 62 is shown in interrupted form in FIG. 4 and is preferably of a sheeting material conventionally used as a release liner for EAS markers. The array of markers 20 is in the form of rows extending transversely to the long dimension of the web 62, and columns extending parallel to the long dimension of the web 62. To simplify the drawing, only a limited number of the rows of markers are shown in FIG. 4, but it should be understood that the rows of markers are provided, in a preferred embodiment, along most or all of the length of the web 62. The overall length of the web 62 may be, for example, on the order of 1,000 meters, and the web preferably carries thousands of rows of markers, of which only a few rows are shown in the drawing. A motorized take-up mechanism 64 and a motorized supply mechanism 66 (both schematically shown in FIG. 4) are provided to permit the web 62 to be selectively advanced along its length in the direction indicated by arrow 68.

A magnetizer element 70 is mounted on a robotic arm, schematically indicated at 72. The robot arm 72 is adapted to transport the magnetizer element 70 in a first direction, indicated by arrow 74, and transverse to the length of the web 62, and also to transport the magnetizer element 70 in an opposite direction represented by arrow 76. A control circuit 78 is provided to control operation of the take-up and supply mechanisms 64, 66 and the robot arm 72.

Figure 5:
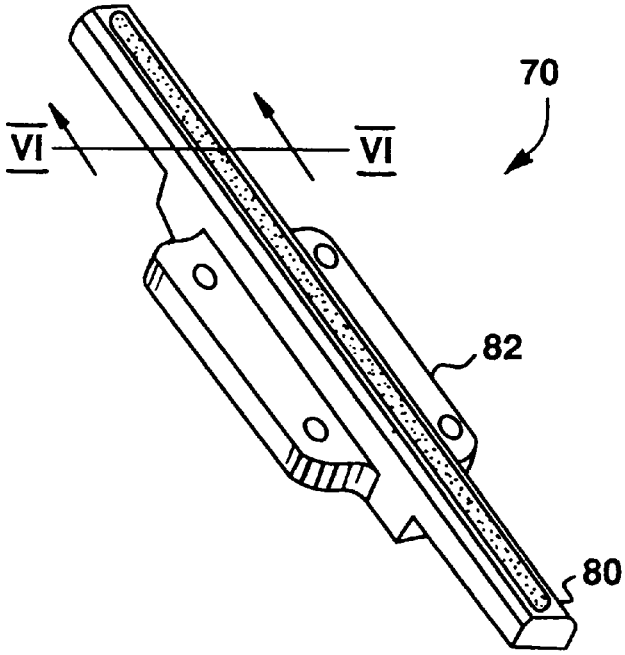
FIG. 5 is an isometric view of a magnetizer element used in the apparatus of FIG. 4.
Figure 6:
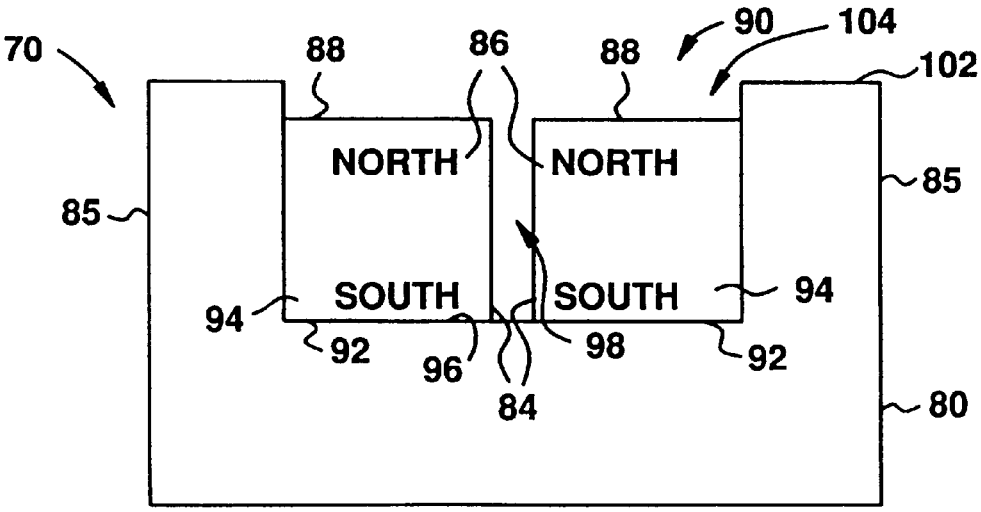
FIG. 6 is a cross-sectional view of the magnetizer taken at the line VI—VI in FIG. 5.
Figure 7:
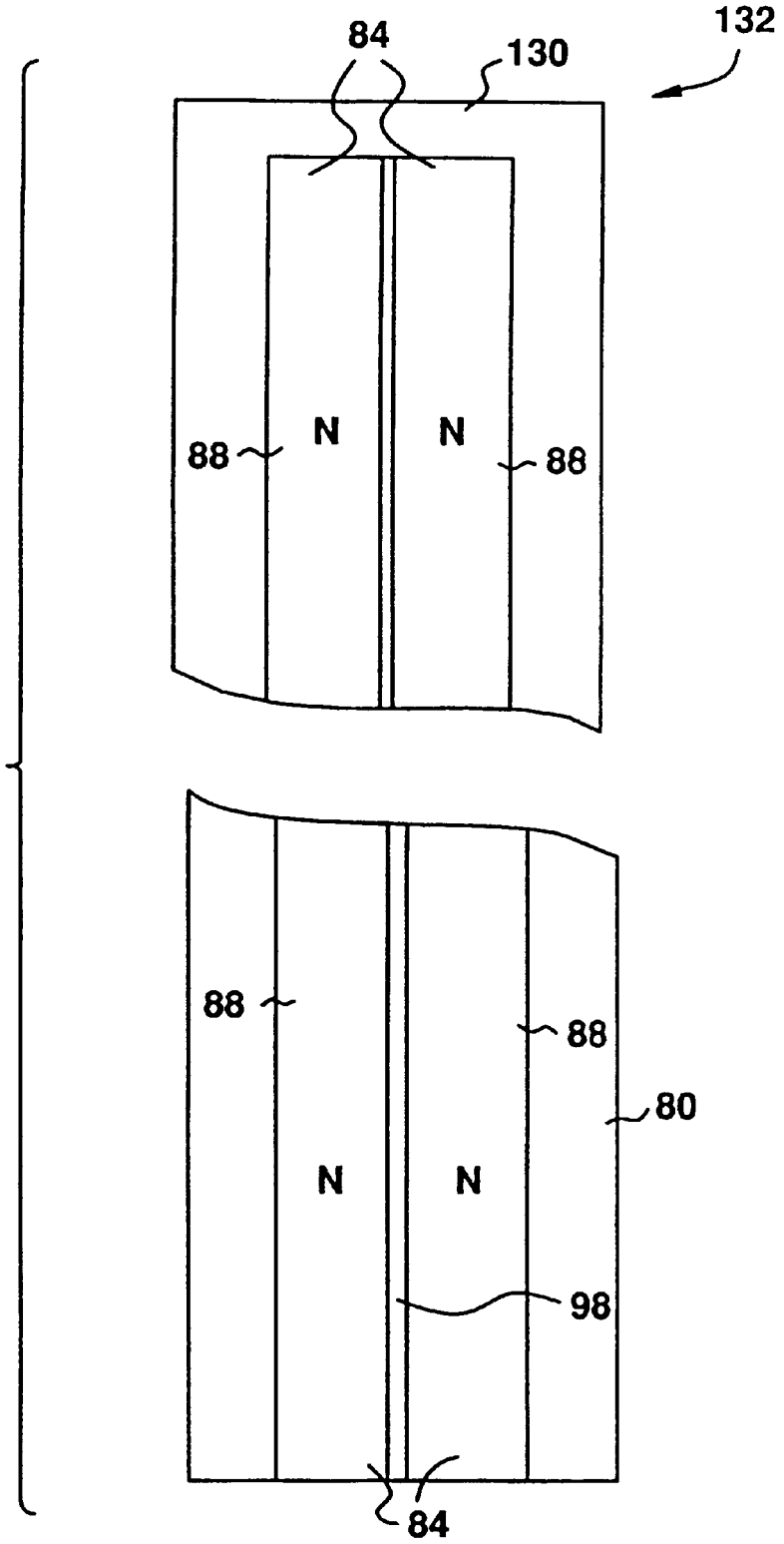
FIG. 7 is an interrupted top view of a major component of the magnetizer of FIG. 5.

Details of the magnetizer element 70 will now be provided with reference to FIGS. 5–7. In FIG. 5, the magnetizer element 70 is seen as including a steel channel 80 and a holder 82 used to mount the channel 80 on the robotic arm 72. The steel channel 80 may, for example, be made of 1018 magnetic steel. As seen from the cross-sectional view of the channel 80, shown in FIG. 6, it is seen that the channel 80 has a substantially U-shaped cross-section. Elongated permanent bar magnets 84, having a rectangular cross-section, are mounted in the channel 80. The magnets 84 are mounted in the channel 80 side-by-side and between side walls 85 of the channel 80, with the lengths of the magnets parallel to the length of the channel. Each of the magnets 84 has a north polarity region 86 formed at a top side 88 of the magnet, which is oriented upwardly toward an open side 90 of the channel 80. At the opposite (lower) side 92 of the magnets 84, there is a south polarity region 94. As seen from FIG. 6, the magnets 84 are mounted with their lower sides 92 abutting a floor 96 of the channel 80. A gap 98 is provided between the adjacent magnets 84. It will also be noted that the top sides 88 of the magnets 84 are recessed from a top edge 102 of the channel 80 to form a space 104.

Preferably, the magnets 84 are formed of neodymium iron boron, and the gap 98 and space 104 are filled by sealing and spacer material (not shown) to prevent corrosion of the magnets 84. Other suitable materials for the magnets 84 include alnico, ferrite or bonded or ceramic magnetic materials.

The overall length of the channel 80 may be around 11 inches. An overall width of the channel 80 may be about 0.35 inches, and the internal width (width of floor 96), may be about 0.225 inches. The side walls 85 may have a thickness of about 0.0625 inches. As seen from FIG. 4, the long dimension of the channel 80, and hence the magnetizer element 70, is held parallel to the long dimension of the web 62 while the magnetizer 70 is transported transversely across the web 62.

The markers 20 are preferably arranged with the lengths of the markers transverse to the length of the web 62, as shown in FIG. 4. Typically, the width of the markers is about 0.5 inches and the space between adjoining rows of markers may be on the order of one-third of an inch. Consequently, it will be appreciated that given a length of magnetizer 70 of 11 inches or more, FIG. 4 somewhat understates the number of rows of markers 20 that can be simultaneously scanned by the magnetizer 70.

Figure 10:
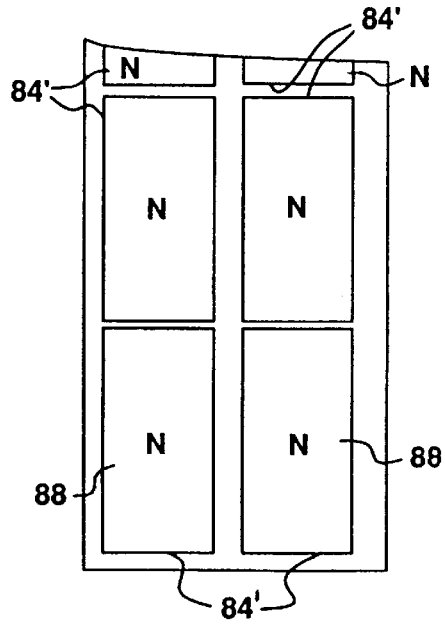
FIG. 10 is a partial top view of an alternative embodiment of the component of the magnetizer shown in FIG. 7.

In cross-section, the magnets 84 may be about 0.1 inch square, and the length of the magnets 84 may be substantially equal to the length of the channel 80. Alternatively, as indicated in FIG. 10, each of the magnets 84 may be replaced by a row of shorter bar magnets 84' arranged end-to-end, and all having rectangular cross-sections and north polarity regions 88 oriented upwardly. For example, the magnets 84' may be about 3.5 inches long.

Figure 8:
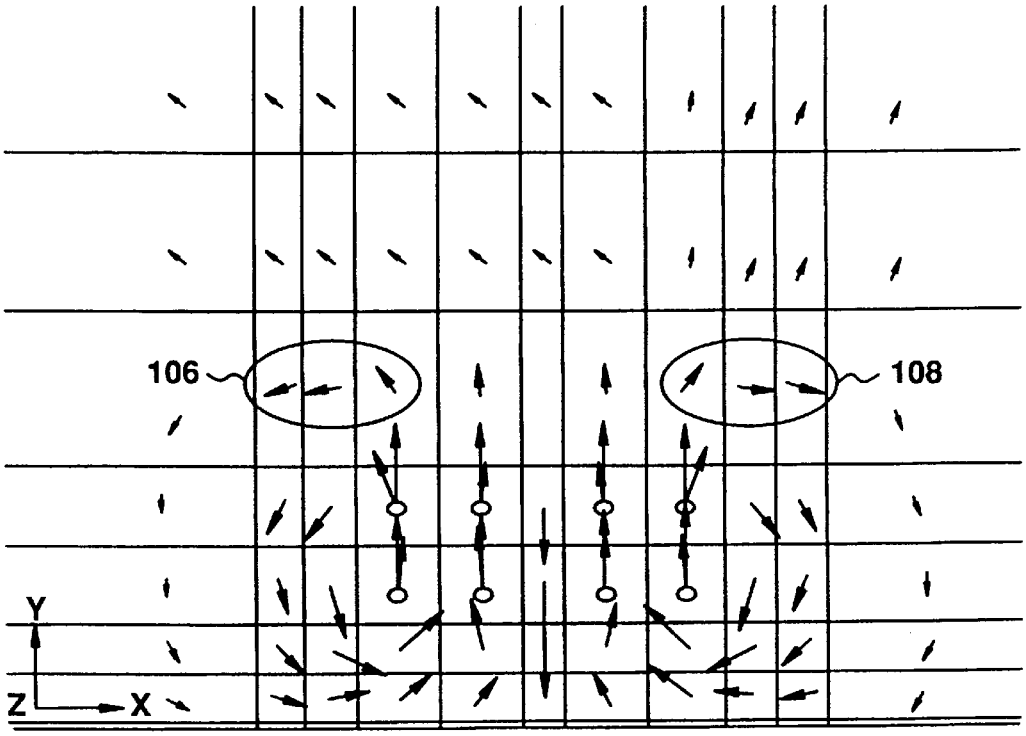
FIG. 8 is a finite element vector plot illustrating a magnetic field formed by the magnetizer of FIG. 5.

FIG. 8 is a vector plot illustrative of the magnetic field formed at central portions of the magnetizer 70 and in a plane normal to the length of the magnetizer 70. The X dimension of FIG. 8 corresponds to the horizontal direction in FIG. 6, and the Y dimension corresponds to the vertical direction in FIG. 6. It is notable that the horizontal (x-direction) component of the flux lines at 106 in FIG. 8 is opposite in direction to the horizontal component of the flux lines at 108 at FIG. 8.

Figure 9:
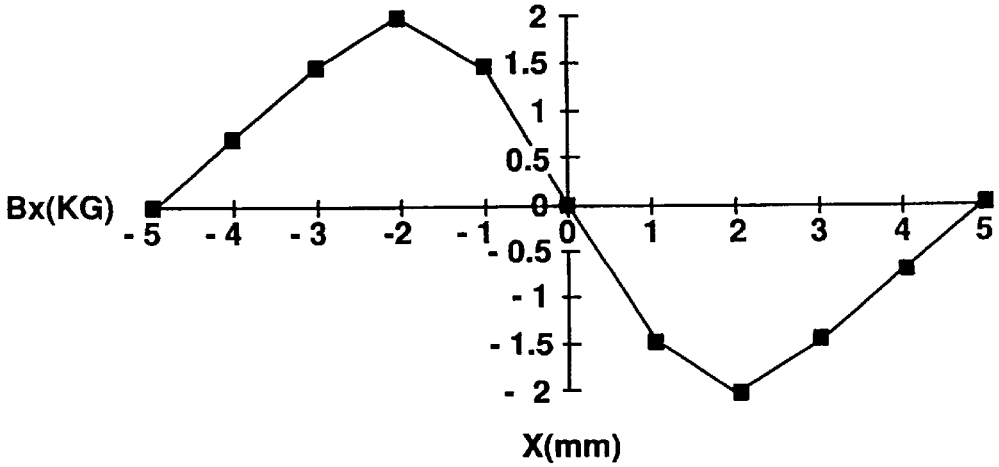
FIG. 9 is a graph illustrating variations in a lateral magnetic induction field formed proximate to the magnetizer of FIG. 5.

FIG. 9 graphs the horizontal-direction magnetic induction field, as a function of horizontal (x-direction) position from left to right and a short distance above top sides 88 of the magnets 84 as portrayed in FIG. 6. It will be seen from FIG. 9 that the X direction magnetic field has one polarity at the left side of the magnetizer cross-section and an opposite polarity at the right side of the magnetizer cross-section. The maximum field amplitude is about 2 KG. If a bias element is swept across from left to right and a short distance above the magnets 84 (as presented in FIG. 6) and with the length of the bias element oriented in the X direction, then the bias element will be magnetized with a first polarity along its length, whereas sweeping the bias element in the opposite direction will magnetize the bias element with the opposite polarity. of course, the sweeping may be obtained by moving the magnetizer relative to the bias element, as is indicated in FIG. 4.

Figure 12:
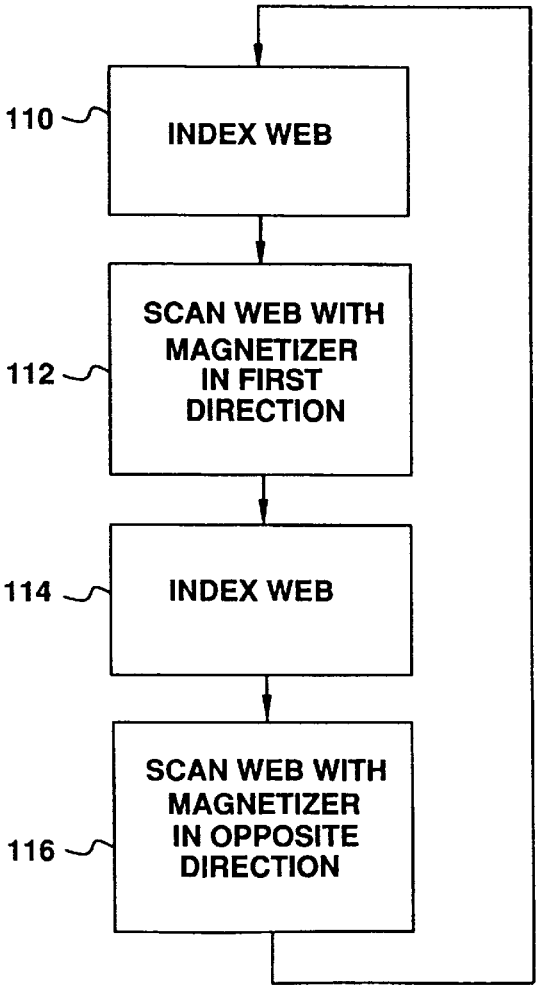
FIG. 12 illustrates in flow-diagram form a process carried out by the apparatus of FIG. 4.

In operation, the control circuit 78 causes the apparatus 60 to perform the sequence of steps shown in FIG. 12. Initially in FIG. 12, as indicated by a step 110, the web is indexed, that is, advanced by a predetermined amount in the direction indicated by arrow 68 (FIG. 4). After step 110 is a step 112 (FIG. 12) at which the robot arm 72 is operated to cause the magnetizer 70 to scan across the web 62, e.g., in the direction indicated by arrow 74. Preferably the markers 20 are adhered to the web 62 with their respective bias elements 26 adjacent the web 62, and the magnetizer 70 scans underneath the web 62 with the top edge 102 of the channel 80 (FIG. 6) in contact with or very close to an underside of the web 62. Consequently, the field profile shown in FIG. 9 is applied to all of the bias elements in the markers carried on the scanned portion of the web 62 in such a manner that the field profile shown is swept along the length of the bias elements. As a result, all of the bias elements carried on the scanned portion of the web 62 are magnetized with a first polarity along the length of the bias elements.

The strength of the magnets 84, and the vertical distance between the bias elements and the top sides 88 of the magnets 84, may be selected so as to provide a maximum field strength of about 500 to 700 Oe at the bias elements. For example, the vertical distance between the bias elements and the tops of the magnets 84 may be about 0.065 inches.

Following step 112 is step 114, at which the web is again advanced by the predetermined amount, and then step 116 is carried out. At step 116, the magnetizer is caused to scan the web in a direction (e.g., that indicated by arrow 76), which is opposite to the scanning direction of step 112. Consequently, another group of bias elements is magnetized, with a polarity opposite to the polarity of magnetization produced in step 112.

As indicated in FIG. 12, the steps 110 through 116 are carried out as an endless loop, to form groups of marker bias elements, magnetized with an opposite polarity, that alternate along the length of the web 62.

Figure 13:
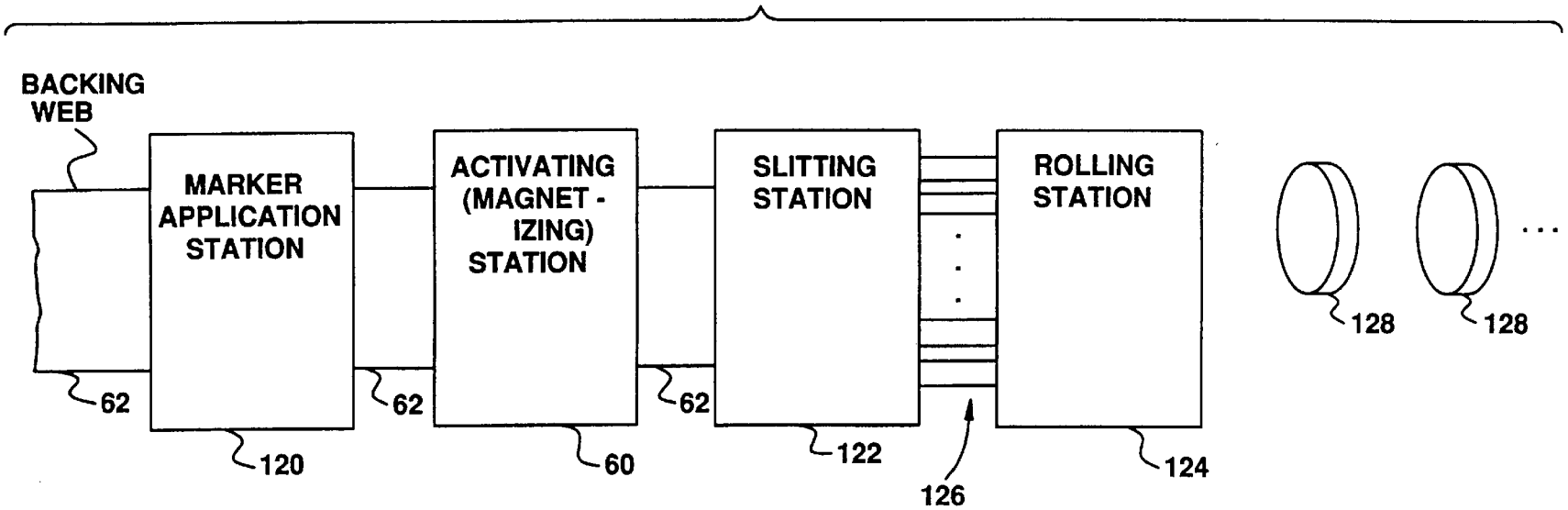
FIG. 13 is a partially block, partially schematic, representation of practices carried out in accordance with the invention to produce rolls of activated EAS markers.

FIG. 13 presents a larger context for the magnetizing process carried out by the apparatus of FIG. 4. FIG. 13 schematically illustrates processing of the backing sheet web 62 through a marker application station 120, an activating station which corresponds to the magnetizing apparatus 60 of FIG. 4, a slitting station 122 and a rolling station 124. Although not shown in FIG. 13, it should be understood that a mechanism is provided to advance the web 62 from left to right, i.e., through the stations 120, 60 and 122 and then to the station 124.

At the marker application station 120, rows of the markers are applied to the web 62 in sequence along the length of the web as the web is advanced through the station 120. Each row of markers extends substantially across the width of the web 62 and the markers are oriented with their length dimensions transverse to the length of the web 62, to produce the two-dimensional array of markers of which a portion is illustrated in FIG. 4. (To simplify FIG. 13, the markers are not shown on the portions of web 62 which are downstream from the marker application station 120.)

At the marker activating station 60, as previously discussed, the web 62 is alternately advanced in increments or steps, and the magnetizing element is scanned across the web 62 in opposite directions, so that alternate groups of markers positioned along the length of the web 62 are activated with the respective bias elements magnetized in opposite directions. Then, at station 122, the web 62 is slit in the longitudinal direction thereof to produce separate backing web strips 126, each of which bears a single column of the marker array. It will be appreciated that alternate sequences of markers on each of the strips 126 have bias elements that are magnetized with opposite polarities.

At the rolling station 124, each of the web strips 126, with the respective column of markers carried thereon, is rolled in a spiral fashion to form substantially cylindrical marker rolls 128, shown schematically as the output of the marker processing line of FIG. 13. Hundreds or thousands of markers, perhaps as many as 5,000 markers, may be included in each roll 128. A roll containing 2,500 markers would typically occupy a volume of about 1,500 cc. Because substantially half of the bias elements of the markers in each roll are magnetized with a north polarity oriented in one direction transverse to the web strip, and the other half of the marker bias elements have their north polarities oriented in the opposite direction, little or no leakage magnetic field is formed by the markers rolls 128, and there is substantially no risk that bias elements in the markers at the periphery of the roll 128 will be inadvertently demagnetized. The maximum leakage field formed by each roll 128 is at a level of 10 Oe or less.

There will now be described, with further reference to FIG. 4, additional considerations involved in activating the web-carried markers using the apparatus shown in FIG. 4 and the procedure illustrated in FIG. 12.

In order to assure consistent and satisfactory performance of the markers, it is important that the direction of magnetic orientation of the bias elements be closely aligned with the longitudinal direction of the bias elements. It is therefore important that the direction in which magnetizer element 70 scans the markers 20 be closely controlled. In a preferred embodiment of the invention, guide rails (not shown) are provided extending across the path of the web to define the locus and direction at which the magnetizer 70 is transported across the web 62. In addition, the transport mechanism for the web 62 is preferably arranged so that the longitudinal direction of the web 62 may be rotated by a few degrees in a horizontal plane so that the rows of markers can be aligned with the magnetizer transport path. A laser sighting device may be directed down the interval between adjacent rows of markers to assure that the desired alignment has been achieved.

At the same time, the web transport mechanism should be operated so that the gap between two successive rows of the markers is aligned with the effective edge of the magnetic field provided by the magnetizer element 70. Otherwise, it is likely that a row of markers will be subjected to edge effects, and not satisfactorily magnetized. To confine the edge of the magnetic field to a narrow boundary area, a preferred embodiment of the steel channel 80 includes a steel end plate 130 (FIG. 7) at a leading end 132 of the channel 80. The end plate 130 is preferably of the same material as the channel 80, and is a planar element oriented orthogonally to the length of the channel 80. The end plate 130 may have a thickness of about 0.050 in. The leading end 132 of the channel 80 is the end corresponding to the direction for advancing the web, as indicated by the arrow 68 in FIG. 4, and corresponds to the leading end 134 of the magnetizer 70, as indicated in FIG. 4.

Providing the end plate 130 makes it feasible to reduce the interval between successive rows of markers to a minimum distance such as 0.25 in.

The increment by which the web 62 is advanced at step 110 or 114 should be equal to an integral multiple of the pitch at which rows of markers are arranged along the web 62, and also should be equal to or less than the length of the magnetizer element 70.

Figure 11:
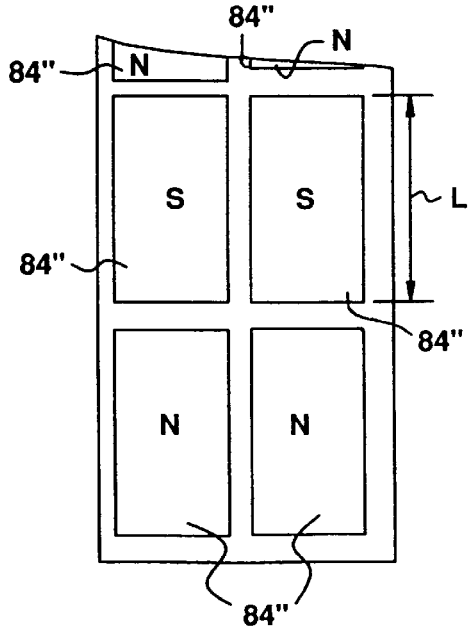
FIG. 11 is a top view of another alternative embodiment of the component of the magnetizer shown in FIG. 7.

A preferred embodiment of the invention calls for magnetizing the bias elements of each row of markers with a polarity opposite to that of the markers in the preceding row. For that purpose, magnets are mounted in the steel channel 80 according to the format shown in FIG. 11. The arrangement of magnets shown in FIG. 11 is like that of FIG. 10 in that two adjacent rows of magnets, extending along the length of the magnetizer, are provided. However, in the arrangement of FIG. 11, each of the magnets 84" shown therein has its north polarity oriented in the opposite direction from the adjoining magnets in the row. Moreover, each of the magnets 84" has a length L which is not less than the width of the markers 20. The pitch at which the magnets 84" are arranged along the channel should be the same as the pitch at which the rows of markers are arranged along the web. The length L of the magnets should therefore not exceed the pitch of the rows of markers.

When the arrangement of magnets shown in FIG. 11 is used, it will be appreciated that the resulting rolls of markers are arranged so that the north polarity of the bias element of each marker is oriented in the opposite direction from that of adjoining markers on the roll.

According to alternative embodiments of the invention, the magnetizer element 70 may be transported above the web 62 rather than below the web. Moreover, the two bar magnets 84 shown in FIGS. 6 and 7 may be replaced with a single bar magnet, or the two rows of magnets shown in FIGS. 10 and 11, may, in each case, be replaced with a single row of magnets. As another alternative, the gap 98 (FIG. 6) between the bar magnets 84 may be eliminated.

Figure 14:
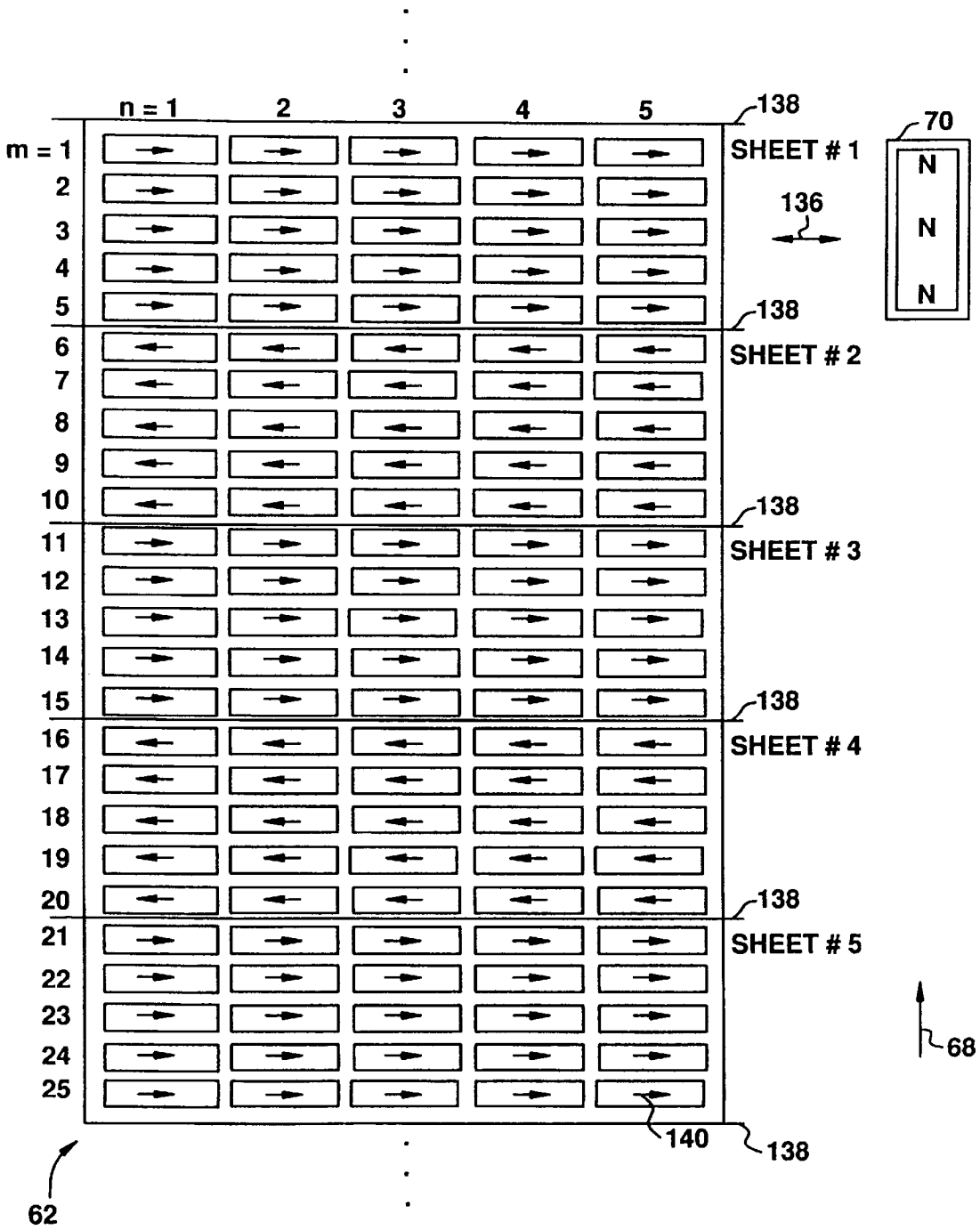
FIG. 14 schematically illustrates a practice carried out in accordance with the invention to produce stacks of marker-carrying sheets.
Figure 15:
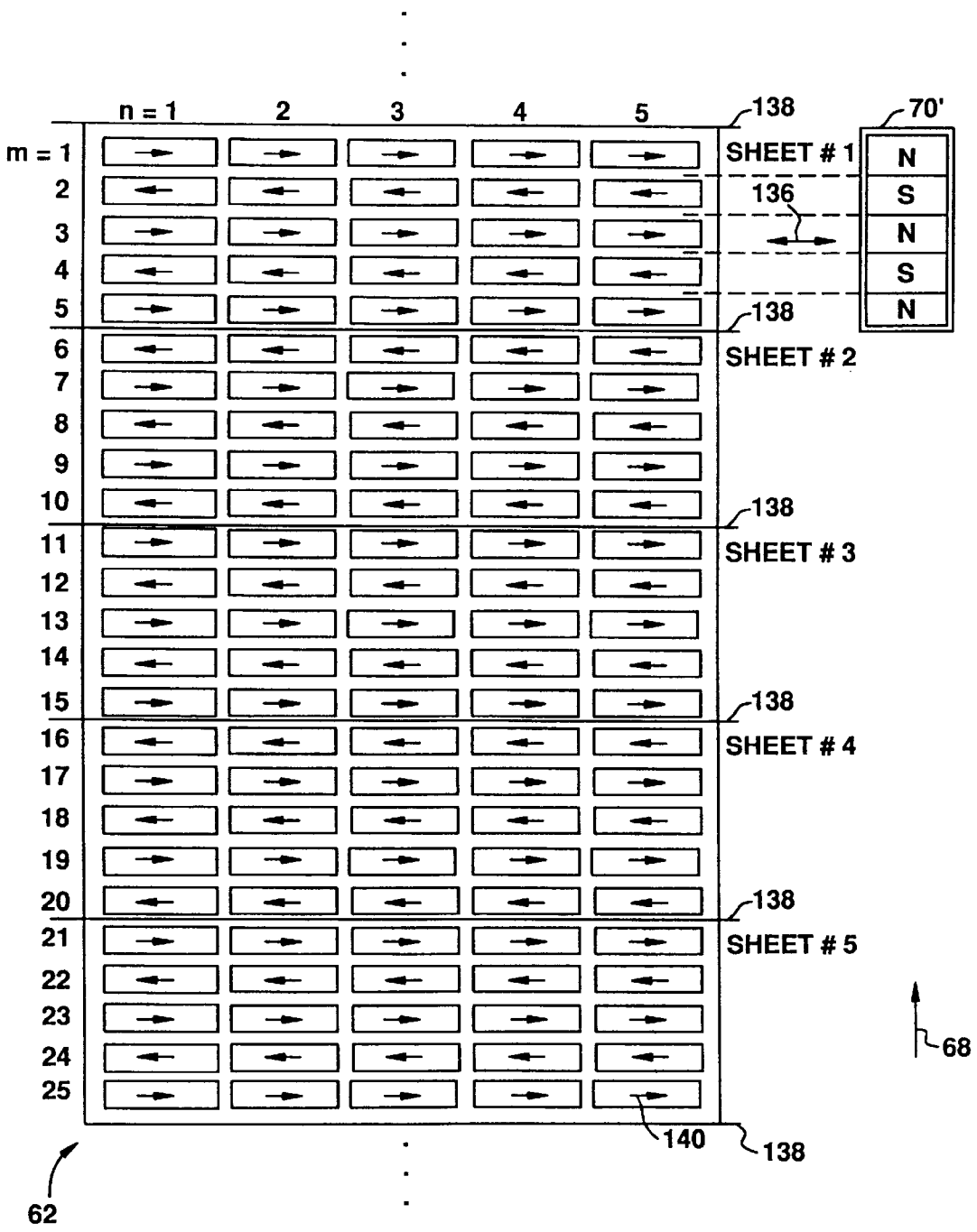
FIG. 15 schematically illustrates an alternative to the practice of FIG. 14.

FIGS. 14 and 15 schematically illustrate alternatives to the process shown in FIG. 13. The processes shown in FIGS. 14 and 15 produce cut sheets with activated markers attached, rather than rolls of markers such as are produced by the process of FIG. 13.

Shown in FIG. 14 is a continuous web 62 of backing material with markers adhered thereto in rows and columns. For purposes of illustration the number n of columns is assumed to be five, and the number m of rows is assumed to be large, with 25 of the rows shown. Also shown in FIG. 14 (in simplified form) is a magnetizer element 70, like that of FIGS. 6 and 7. As before, the magnetizer is arranged to be reciprocated in a direction transverse to the length of the web 6 (as indicated by the double-headed arrow mark 136) and with the length of the magnetizer element parallel to the length of the web. It is assumed that the magnetizer element is long enough to magnetize five rows of markers on the web during each pass. Once again the arrow mark 68 indicates the direction in which the web is advanced.

The process of FIG. 14 departs from that of FIG. 13 by having a slitting station that slits the web transversely, to produce cut sheets (rather than longitudinally to produce web strips, as in FIG. 13). Lines 138 are indicative of loci at which the transverse slitting is performed. As in the process of FIG. 13, slitting is performed downstream from the magnetizing station.

In operation, the process illustrated in FIG. 14 entails advancing the web by a fixed increment, assumed in this case to be 5 times the pitch of the marker rows (i.e. equal to the distance from one line 138 to the next). Then the magnetizer 70 is transported across the width of the web in a first direction to magnetize the respective bias elements of five rows of markers. Next the web is again advanced by the 5-row increment, and the magnetizer is transported back across the web (i.e. in the opposite direction) to magnetize with an opposite polarity the bias elements of the next five rows of markers. The small horizontal arrows (of which one is identified with reference numeral 140) are indicative of the respective directions in which the bias elements of each marker are magnetized by the magnetizer element 170.

The web-advancement and magnetizer-transport steps described above are continuously repeated. In addition, downstream from the magnetizer, the web is transversely slit at the positions indicated by lines 138 to form cut sheets, each of which carries a group of markers which was activated in a single pass of the magnetizer element. As seen from FIG. 14, each resulting cut sheet has markers for which the bias element are all magnetized in the same direction. Also, the direction of magnetization of the markers on each sheet is opposite to the direction of magnetization of the markers on the previous sheet. Consequently, the cut sheets can be stacked one after the other to produce the same type of stack of marker-bearing sheets that is produced by the practice discussed in connection with FIG. 3. It is to be appreciated that the process of FIG. 14 is likely to be more efficient and less labor-intensive than the process of FIG. 3, particularly since the process of FIG. 14 does not require the sheets of markers to be rotated by hand.

Although the example shown in FIG. 3 would result in a 5×5 array of markers on each cut sheet, there are many possible variations on the array dimensions. One such variation would produce a marker array of 18 rows by 6 columns on each cut sheet.

The process of FIG. 15 is the same as in FIG. 14, except that FIG. 15 shows a magnetizer element 70' configured to cause the direction of magnetization of the markers to alternate from row to row. The magnetizer element 70' (shown in simplified form in FIG. 15) has an alternating polarity magnet array arranged along the length of the magnetizer element, like the magnetizer element shown in FIG. 11.

The number of rows of markers in a group activated in each pass of the magnetizer element 70' may be odd, as shown in FIG. 15, or may be even. In either case, in the resulting stack of markers, the bias element in each marker will be magnetized with a polarity opposite to those of the markers immediately below and above. Where an even number of rows is activated at each pass, the first row of each group is magnetized with the same polarity as the last row of the preceding group. Accordingly, two successive rows magnetized with the same polarity are produced at each boundary between groups. However, the web is slit at the boundary and between the two successive rows to produce sheets that are stacked so that the direction of magnetization alternates in the vertical dimension of the stack. Also, on each cut sheet itself, no two adjacent rows of markers have the same polarity.

In a further variation, the sheets of markers produced by the process of FIG. 15 may be cut down to the granularity of a single marker, and the single markers loaded into a cartridge to be used for feeding a marker applicator gun. When the markers are loaded in such a cartridge the density of the accumulated markers is particularly high. For example, a cartridge may contain 250 markers within a volume of about 125 cc. This makes it especially important to include in the cartridge approximately equal numbers of markers of each polarity. It is also important that markers of each polarity be distributed rather evenly throughout the cartridge.

Various changes in the foregoing apparatus and modifications in the described practices may be introduced without departing from the invention. The particularly preferred embodiments are thus intended in an illustrative and not limiting sense. The true spirit and scope of the invention is set forth in the following claims.

What is claimed is:

1. A roll assembly of magnetomechanical EAS markers, comprising:

a backing sheet having a length extent and a width extent, said length extent being at least 10 times as long as said width extent; and a plurality of magnetomechanical markers adhered to said backing sheet, said markers each including an active element for resonating in response to an EAS interrogation signal and a bias element for applying a bias magnetic field to said active element, each said marker having a longitudinal axis and being oriented relative to said backing sheet so that said longitudinal axis is transverse to the length extent of said backing sheet, said plurality of markers consisting of a first subset and a second subset, the markers of said first subset having respective bias elements that are magnetized with a north polarity oriented in a first direction that is transverse relative to the length extent of said backing sheet, the markers of said second subset having respective bias elements that are magnetized with a north polarity oriented in a second direction that is transverse relative to the length extent of said backing sheet and is opposite to the first direction, each of said first and second subsets consisting of at least 30% and no more than 70% of said plurality of markers.

2. A roll assembly according to claim 1, wherein each of said first and second subsets consists of substantially 50% of said plurality of markers.

3. A roll assembly according to claim 1, wherein said plurality of markers includes at least 500 markers.

4. A roll assembly according to claim 3, wherein said plurality of markers includes at least 1,000 markers.

5. A roll assembly according to claim 4, wherein the bias elements of the markers of said roll assembly do not collectively produce a demagnetization field that exceeds 10 Oe.

6. A roll assembly according to claim 5, wherein said backing sheet is rolled so as to form said assembly into a substantially cylindrical shape.

7. A roll assembly according to claim 6, wherein said plurality of markers includes at least 2,500 markers.

8. A roll assembly according to claim 7, wherein said plurality of markers includes at least 5,000 markers.

9. A roll assembly according to claim 7, wherein said roll assembly occupies a volume of less than 1,500 cc.

10. A roll assembly according to claim 1, wherein each adjacent pair of said plurality of markers on said backing sheet includes a marker from said first subset and a marker from said second subset.

11. A roll assembly of magnetomechanical EAS markers, comprising:

a backing sheet having a length extent and a width extent, said length extent being at a least 10 times as long as said width extent; and a plurality of magnetomechanical markers adhered to said backing sheet, said markers each including an active element for resonating in response to an EAS interrogation signal and a bias element for applying a bias magnetic field to said active element, the bias element of each said marker being magnetized so as to bias the active element of the respective marker to be resonant at a predetermined operating frequency of an EAS system, said plurality of markers including at least 500 markers, said backing sheet being rolled so as to form said assembly into a substantially cylindrical shape, and said bias elements of said plurality of markers not collectively producing a demagnetization field that exceeds 10 Oe.

12. A roll assembly according to claim 11, wherein said plurality of markers includes at least 1000 markers.

13. A roll assembly according to claim 12, wherein said plurality of markers includes at least 2500 markers.

14. A roll assembly according to claim 13, wherein said plurality of markers includes at least 5000 markers.

15. A roll assembly according to claim 13, wherein said roll assembly occupies a volume of less than 1,500 cc.

16. A method of activating magnetomechanical EAS markers adhered to a continuous web, the method comprising the steps of:

first transporting a magnetizer element in a first direction transverse to said web and in proximity to a first group of said markers to magnetize respective bias elements of said first group of said markers;

after said first transporting step, indexing said web in a longitudinal direction of said web; and after said indexing step, second transporting said magnetizer element in a second direction transverse to said web, opposite to said first direction, and in proximity to a second group of said markers different from said first group, to magnetize respective bias elements of said second group of markers.

17. A method according to claim 16, wherein said first group of markers includes some but not all of the markers in said second group of markers.

18. A method according to claim 16, wherein said magnetizer element has a length extent, and said transporting steps are performed with said length extent of said magnetizer element parallel to said longitudinal direction of said web.

19. A method according to claim 18, wherein said indexing step consists of moving said web in said longitudinal direction thereof by a distance that is substantially equal to said length extent of said magnetizer element.

20. A method according to claim 18, wherein said indexing step consists of moving said web in said longitudinal direction thereof by a distance that is less than said length extent of said magnetizer element.

21. A method according to claim 16, further comprising the steps of:

after said second transporting step, slitting the web in a direction parallel to the longitudinal direction of the web to form plural web-strips each carrying at least 50 of said markers, and rolling said web-strips.

22. A method according to claim 16, further comprising the step of:

sequentially slitting the web in a direction transverse to the longitudinal direction of the web to produce a sequence of cut sheets, each carrying at least 20 markers.

23. A method according to claim 22, further comprising the step of stacking said cut sheets.

24. A magnetizer element for activating magnetomechanical EAS markers, the magnetizer element comprising:

a steel channel having a substantially U-shaped cross-section and a length extent transversely extending relative to said cross section; and a magnet housed in said channel and having a length extent parallel to said length extent of said channel, said magnet having a first magnetic polarity region on a first side of said magnet and extending parallel to said length extent and along an open side of said channel, and a second magnetic polarity region extending parallel to said length extent and on a second side of said magnet opposite to said first side, said second magnetic polarity region having a magnetic polarity opposite to that of said first region.

25. A magnetizer element according to claim 24, wherein said first magnetic polarity region is a north pole and said second magnetic polarity region is a south pole.

26. A magnetizer element according to claim 24, wherein said first magnetic polarity region is a south pole and said second magnetic polarity region is a north pole.

27. A magnetizer element according to claim 24, wherein said steel channel has first and second end portions at opposite ends of said length extent, and further comprising an end plate arranged at said first end portion of said steel channel and oriented orthogonally to said length extent.

28. A magnetizer element for activating magnetomechanical EAS markers, the magnetizer element comprising:

a steel channel having a substantially U-shaped cross-section and a length extent transversely extending relative to said cross section;

a first plurality of discrete permanent magnets arranged adjacent one another in a first row;

a second plurality of discrete permanent magnets arranged adjacent one another in a second row;

said first and second rows of magnets being mounted in said steel channel and both extending in parallel to said length extent of said steel channel;

every magnet of said first and second pluralities having a first magnetic polarity region on a first side of the respective magnet, said first side being oriented toward an open side of said channel, and a second magnetic polarity region on a second side of the respective magnet opposite to said first side, said second magnetic polarity region having a magnetic polarity opposite to that of said first region, all of said first regions having the same magnetic polarity.

29. A magnetizer element according to claim 28, wherein each of said first magnetic polarity regions is a north pole and each of said second magnetic polarity regions is a south pole.

30. A magnetizer element according to claim 28, wherein each of said first magnetic polarity regions is a south pole and each of said second magnetic polarity regions is a north pole.

31. A magnetizer element according to claim 28, wherein said steel channel has first and second end portions at opposite ends of said length extent, and further comprising an end plate arranged at said first end portion of said steel channel and oriented orthogonally to said length extent.

32. A magnetizer element according to claim 28, wherein said permanent magnets are formed of a material selected from the group consisting of neodymium iron boron, alnico, ferrite, a ceramic magnetic material, and a bonded magnetic material.

33. A magnetizer element for activating magnetomechanical EAS markers, the magnetizer element comprising:

a steel channel having a substantially U-shaped cross-section and a length extent transversely extending relative to said cross section;

a first plurality of discrete permanent magnets arranged adjacent one another in a first row, said first row of magnets being mounted in said steel channel so as to extend in parallel to said length extent of said steel channel, each of said first plurality of discrete permanent magnets having a length extent arranged parallel to said length extent of said channel, said length extent of said discrete magnets being no longer than a pitch distance at which rows of said EAS markers are arranged along a web to be scanned with said magnetizer element.

34. A magnetizer element according to claim 33, wherein each of said magnets has a first side oriented toward an open side of said steel channel and a first magnetic polarity region at said first side and having a magnetic polarity opposite to a magnetic polarity of the first magnetic polarity region of an adjoining one of said magnets.

35. A magnetizer element according to claim 34, further comprising a second plurality of discrete permanent magnets arranged adjacent one another in a second row mounted in said steel channel parallel to said first row of magnets, each magnet of said second row being located adjacent a corresponding magnet of the first row and having a length extent substantially equal to the length extent of the corresponding magnet of the first row, each magnet of the second row having a first side oriented toward said open end of the steel channel and a first magnetic polarity region at said first side and having a magnetic polarity that is the same as the magnetic polarity of the first magnetic polarity region of the corresponding magnet of the first row.

36. A magnetizer element according to claim 33, wherein said steel channel has first and second end portions at opposite ends of said length extent of said channel, and further comprising an end plate arranged at said first end portion of said channel and oriented orthogonally to said length extent of said channel.

37. A magnetizer element according to claim 33, wherein said permanent magnets are formed of a material selected from the group consisting of neodymium iron boron, alnico, ferrite, a ceramic magnetic material, and a bonded magnetic material.

38. A magnetizer element according to claim 33, wherein said length extent of said discrete magnets is not substantially shorter than a width extent of said EAS markers.

39. Apparatus for activating magnetomechanical EAS markers adhered to a continuous web, the apparatus comprising:

means for advancing said web in increments in a longitudinal direction of said web;

a magnetizer element;

transport means for transporting said magnetizer element in a first direction transverse to a longitudinal direction of said web before said web is advanced by one of said increments and for transporting said magnetizer element in a second direction, transverse to said web and opposite to said first direction, after said web is advanced by said one of said increments; and control means for controlling said means for advancing and said transport means.

40. Apparatus according to claim 39, wherein each of said increments corresponds to a multiple of a pitch at which said markers are positioned in said longitudinal direction of said web.

41. Apparatus according to claim 39, wherein said magnetizer element has a length extent, and said means for transporting transports said magnetizer element in said first and second directions with said magnetizer element oriented so that said length extent of said magnetizer element is parallel to said longitudinal direction of said web.

42. Apparatus according to claim 39, further comprising means, downstream from said transport means, for slitting the web in a direction parallel to the longitudinal direction of the web to form plural web strips.

43. Apparatus according to claim 42, further comprising means, downstream from said slitting means, for rolling said web strips.

44. Apparatus according to claim 39, further comprising means, downstream from said transport means, for slitting the web in a direction transverse to the longitudinal direction of the web to form plural cut sheets.

45. An accumulation of a plurality of magnetomechanical EAS markers, said markers each including an active element for resonating in response to an EAS interrogation signal and a bias element for applying a bias magnetic field to said active element, said accumulation of markers comprising a backing sheet to which the markers are adhered, the markers adhered to said backing sheet including a first subset of said markers and a second subset of said markers, the markers of said first subset having respective bias elements that are magnetized with a north polarity oriented in a first direction, and the markers of said second subset having respective bias elements that are magnetized with a north polarity oriented in a second direction different from said first direction.

46. An accumulation of magnetomechanical EAS markers according to claim 45 wherein the markers all have a longitudinal axis and are adhered to the backing sheet with their respective longitudinal axes in parallel, and said second direction is opposite to said first direction.

47. An accumulation of magnetomechanical EAS markers according to claim 46, wherein no more than 60% of the markers are of the first subset and no more than 60% of the markers are of the second subset.

48. An accumulation of magnetomechanical EAS markers according to claim 47, wherein the markers are adhered to the backing sheet in rows.

49. An accumulation of magnetomechanical EAS markers according to claim 48, wherein alternate ones of said rows of markers consist of markers of said first subset, and all others of said rows of markers consist of markers of said second subset.

50. An accumulation of magnetomechanical EAS markers according to claim 49, wherein there are no more than 20 rows of markers on said backing sheet.

51. A stack of a plurality of backing sheets with magnetomechanical markers arranged thereon in accordance with claim 49.

52. A stack of a plurality of backing sheets according to claim 51, wherein no two vertically adjacent markers in the stack have their respective bias elements magnetized with north polarities oriented in the same direction.

53. An accumulation of magnetomechanical EAS markers according to claim 47, wherein said backing sheet has a length dimension at least ten times as long as a width dimension of the backing sheet.

54. An accumulation of magnetomechanical EAS markers according to claim 53, wherein said backing sheet is rolled to form a roll of said markers.

55. An accumulation of a plurality of magnetomechanical EAS markers located in proximity to each other, said markers each including an active element for resonating in response to an EAS interrogation signal and a bias element for applying a bias magnetic field to said active element, each said marker having a longitudinal axis and said plurality of markers all being oriented so as to have their respective longitudinal axes in parallel, said plurality of markers comprising at least 100 markers and consisting of a first subset and a second subset, the markers of said first subset having respective bias elements that are magnetized with a north polarity oriented in a first direction, and the markers of said second subset having respective bias elements that are magnetized with a north polarity oriented in a second direction opposite to said first direction, each of said first and second subsets consisting of at least 30% and no more than 70% of said plurality of markers.

56. An accumulation of magnetomechanical EAS markers according to claim 55, wherein each of said first and second subsets consists of substantially 50% of said plurality of markers.

57. An accumulation of magnetomechanical EAS markers according to claim 55, wherein said plurality of markers includes at least 500 markers.

58. An accumulation of magnetomechanical EAS markers according to claim 57, wherein said plurality of markers includes at least 1000 markers.

59. An accumulation of magnetomechanical EAS markers according to claim 58, wherein the bias elements of said markers do not collectively produce a demagnetization field that exceeds 10 Oe.

60. An accumulation of magnetomechanical EAS markers according to claim 59, wherein said plurality of markers includes at least 2,500 markers.

61. An accumulation of magnetomechanical EAS markers according to claim 60, wherein said plurality of markers includes at least 5,000 markers.

62. An accumulation of magnetomechanical EAS markers according to claim 55, including a plurality of backing sheets to each of which a plurality of said markers are adhered, said plurality of backing sheets being arranged in a stack.

63. An accumulation of magnetomechanical EAS markers according to claim 55, including a continuous backing strip supporting said plurality of markers and rolled so as to have a spiral cross-section.

* * * * *